US010494956B2

(12) United States Patent
Shurrock

(10) Patent No.: US 10,494,956 B2
(45) Date of Patent: Dec. 3, 2019

(54) FASTENER ASSEMBLY FOR SECURING A TURBOMACHINE CASING AND METHOD FOR SECURING THE CASING

(71) Applicant: General Electric Company, Schenectady, NY (US)

(72) Inventor: Timothy George Shurrock, Rugby (GB)

(73) Assignee: General Electric Company, Schenectady, NY (US)

( * ) Notice: Subject to any disclaimer, the term of this patent is extended or adjusted under 35 U.S.C. 154(b) by 10 days.

(21) Appl. No.: 15/784,621

(22) Filed: Oct. 16, 2017

(65) Prior Publication Data

US 2019/0112948 A1 Apr. 18, 2019

(51) Int. Cl.
*F01D 25/26* (2006.01)
*F01D 25/24* (2006.01)

(52) U.S. Cl.
CPC ..... *F01D 25/265* (2013.01); *F01D 25/243* (2013.01); *F05D 2220/31* (2013.01); *F05D 2230/60* (2013.01); *F05D 2240/14* (2013.01); *F05D 2300/50212* (2013.01)

(58) Field of Classification Search
CPC .. F01D 25/265; F01D 25/243; F05D 2220/31; F05D 2230/60; F05D 2240/14; F05D 2300/50212
USPC ..... 415/214.1
See application file for complete search history.

(56) References Cited

U.S. PATENT DOCUMENTS

| | | | | |
|---|---|---|---|---|
| 3,837,522 | A * | 9/1974 | Lesnansky, Jr. ..... | B65D 39/12 220/235 |
| 3,881,843 | A | 5/1975 | Meylan | |
| 6,199,453 | B1 * | 3/2001 | Steinbock ..... | B23P 19/068 29/452 |
| 8,403,628 | B2 | 3/2013 | Koza et al. | |
| 8,821,110 | B2 | 9/2014 | Predmore et al. | |
| 2011/0008125 | A1 * | 1/2011 | Moon ..... | F16B 5/02 411/108 |
| 2011/0296829 | A1 * | 12/2011 | Hayashi ..... | F01D 17/165 60/602 |
| 2012/0282089 | A1 | 11/2012 | Predmore et al. | |
| 2017/0184031 | A1 * | 6/2017 | Hashimoto ..... | F01D 25/26 |

* cited by examiner

*Primary Examiner* — Joseph J Dallo
*Assistant Examiner* — Yi-Kai Wang
(74) *Attorney, Agent, or Firm* — Nixon & Vanderhye P.C.

(57) ABSTRACT

A casing including: a first casing section and a second casing section configured to be joined to the first casing section to form the casing; a first hole extending through a portion of the first casing section; a second hole extending through a portion of the second casing section, wherein the first and second holes are configured to be in alignment while the first and second casing sections are joined; a bushing seated in the second hole; a fastener having a shaft configured to extend through the first hole, extend into the second hole, and seat in and engage the bushing, wherein a thermal expansion coefficient of the bushing is greater than a thermal expansion coefficient of the shaft of the fastener, and the thermal expansion coefficient of the fastener is greater than a thermal expansion coefficients for each of the first and second casing sections.

18 Claims, 3 Drawing Sheets

FASTENER ASSEMBLY FOR SECURING A TURBOMACHINE CASING AND METHOD FOR SECURING THE CASING

FIELD OF THE INVENTION

The invention relates to fasteners to secure sections of the casing of a turbomachine and particularly to bolt and nut assemblies that secure sections of an inner casing of a steam turbine.

BACKGROUND OF THE INVENTION

Casings of a turbomachine are typically divided into sections, such as an upper casing section and a lower casing section. The sections are joined by fasteners, such as by bolts and nut assemblies which are tensioned to provide a closing force on the joint between the upper and lower casing sections and thereby prevent The inner working fluid of a turbomachine is at a high temperature and these high temperatures heat the inner casing of the machine. For example, steam temperatures in modern steam turbines may be at temperatures near 600° Celsius. These high working fluid temperatures heat the inner casing and cause the casing to expand. Similarly, the inner casing contracts as it cools after the working fluid has stopped flowing. The expansion and contraction of the inner casing can affect the fasteners that secure the casing together.

Materials each have a thermal expansion coefficient that indicates the amount of thermal expansion of the material for a standard temperature change. The thermal expansion coefficient of the metal forming the inner casing may be substantially different that the thermal expansion coefficient of the metal forming the bolts that secure the casing together.

If the thermal expansion of the bolts is substantially greater than the thermal expansion of the inner casing, the bolt will expand, e.g., lengthen, to a greater extent than the expansion of the inner casing. The pretension in the bolt which holds closed the joint between the upper and lower inner casing segments reduces as the bolt expands to a greater degree than the inner casing. This reduction in the pretension on the bolt results in leakage of the working fluid, such as steam, through the joint between the upper and lower inner casing segments.

The risk of pretension of the bolts securing inner casings being reduced has become more pronounced in recent years because the materials selected to form inner casings to withstand the hotter steam temperatures in modern steam turbines have a lower thermal expansion coefficient than do the bolts that secure the casings.

To allow for higher steam temperatures, the inner casing is often replaced with a new inner casing which is designed to better withstand the higher temperatures. The new inner casing is designed to fit in and be secured to the existing outer casing. Reusing the outer casing reduces the cost of upgrading the turbomachine, e.g., steam turbine. The materials used to form the new inner casing may have substantially lower thermal expansion coefficients that the bolts used to secure the inner casing.

A technical problem has arisen in recent years because inner casings with low thermal expansion coefficients are being fitted into existing outer casings and because the steam temperatures are increasing in steam turbines. Similar technical problems may be occurring in other turbomachines.

The conventional approach to this technical problem requires a relatively large clearance between certain portions of the inner and outer casings. There remains a need for a solution to the technical problem for inner casings having insufficient clearance with their outer casing.

BRIEF SUMMARY OF INVENTION

To solve the technical problem of dissimilar thermal expansion between a casing of an inner casing of a turbomachine and a fastener securing the casing, a bushing is embedded in the casing and configured to receive the fastener. The bushing secures the fastener to the casing. The bushing, due to its thermal expansion coefficient, expands as the inner casing is heated in a manner that compensates for the difference in expansion of the fastener and the casing. For example, the bushing may have a greater thermal expansion than the fastener if the thermal expansion of the fastener is greater than that of the inner casing.

The thermal expansion of the bushing may cause the end of the fastener secured to the bushing to extend further into the inner casing as the casing, fastener and bushing are heated. Because the end of the bolt extends further into the casing, there is less of a loss of bolt pretension due to the greater thermal expansion of the fastener as compared to the inner casing.

An embodiment of the invention is a casing including: a first casing section and a second casing section configured to be joined to the first casing section to form the casing; a first hole extending through a portion of the first casing section; a second hole extending through a portion of the second casing section, wherein the first and second holes are configured to be in alignment while the first and second casing sections are joined; a bushing seated in the second hole; a fastener having a shaft configured to extend through the first hole, extend into the second hole, and seat in and engage the bushing, wherein a thermal expansion coefficient of the bushing is greater than a thermal expansion coefficient of the shaft of the fastener, and the thermal expansion coefficient of the fastener is greater than a thermal expansion coefficients for each of the first and second casing sections.

An embodiment of the invention is a casing for a turbomachine comprising: a first casing section having a first mating surface; a second casing section having a second mating surface configured to abut the first mating surface of the first casing section; a first bolt hole extending through a portion of the first casing section and having an opening at the first mating surface; a second bolt hole extending through a portion of the second casing section and having an opening at the second mating surface, wherein the first and second bolt holes are configured to be in axial alignment while the first mating surface abuts the second mating surface; a bushing seated in the second bolt hole; and a bolt configured to extend through the first both hole, extend into the second bolt hole, and seat in and engage the bushing, wherein a thermal expansion coefficient of the bushing is greater than a thermal expansion coefficient of the bolt, and the thermal expansion coefficient of the bolt is greater than a thermal expansion coefficients for each of the first and second casing sections.

An embodiment of the invention is a method to fasten casing sections for a turbomachine comprising: inserting a bushing in a first hole in first casing section; engaging a threaded outer surface near a first end of the bushing with an inner threaded surface near an open end of the hole; inserting a bolt in the bushing and the first hole; engaging a thread outer surface near a first end of the bolt with a threaded inner surface near a second end of the bushing, wherein the second end of the bushing is opposite the first end of the bushing;

joining the first casing section to a second casing section such that the first hole is aligned with a second hole in the second casing section; extending the bolt through the second hole, and engaging a nut to threads near a second end of the bolt, wherein a thermal expansion coefficient of the bushing is greater than a thermal expansion coefficient of the bolt, and the thermal expansion coefficient of the bolt is greater than a thermal expansion coefficients for each of the first and second casing sections.

DETAILED DESCRIPTION OF THE INVENTION

Figure 1:
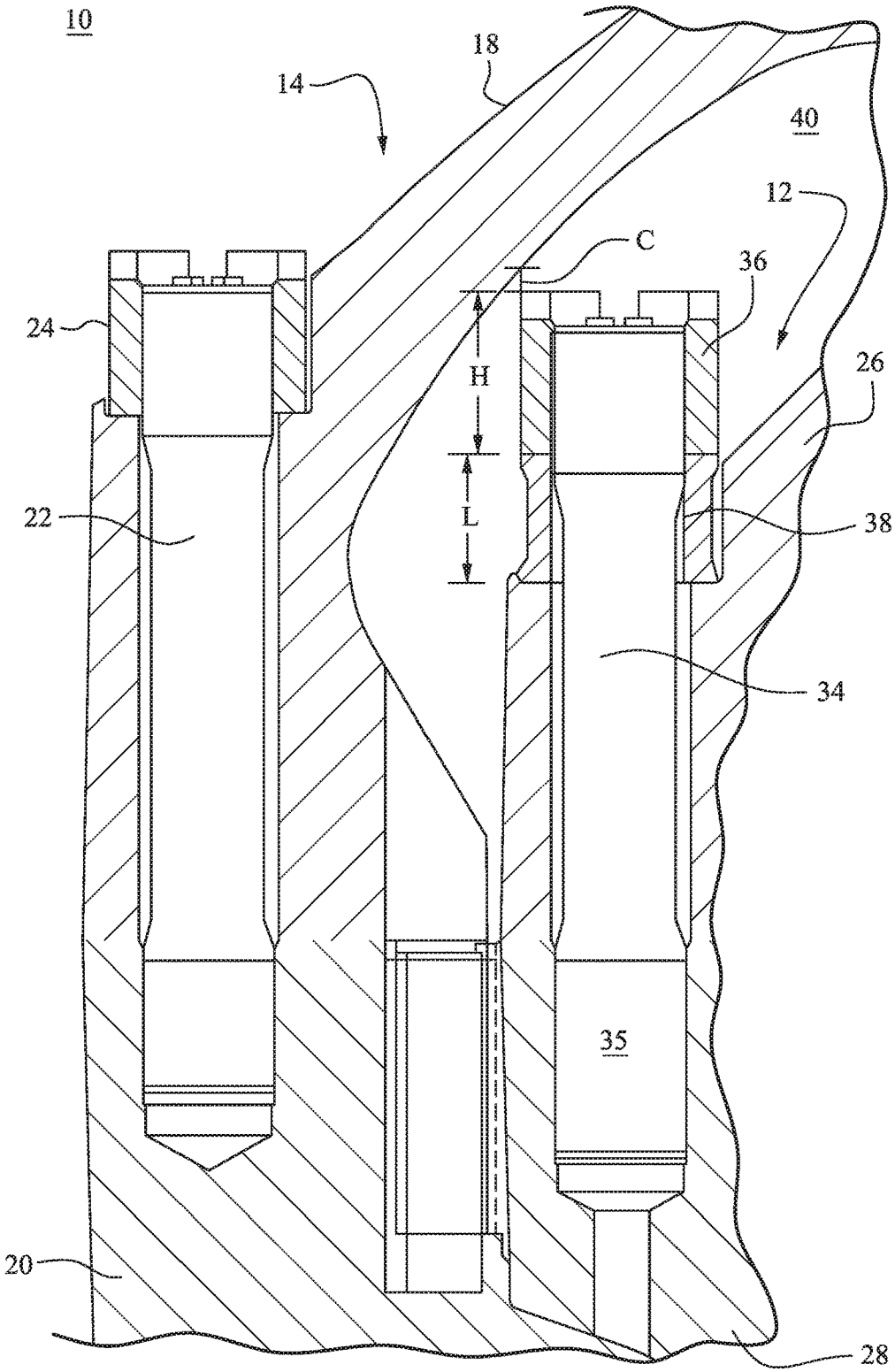
FIGURE 1 Prior Art
FIG. 1 shows a prior art approach to joining the casing sections.

FIG. 1 shows in cross section a portion of a conventional steam turbine 10 having an inner casing 12 and an outer casing 14. The inner casing 12 supports annular rows of stator vanes and annular shrouds surrounding the tips of rotating turbine blades also arranged in rows and housed by the inner casing. Steam flows through the rows of blades and vanes to drive a rotating shaft which outputs work from the steam turbine. The outer casing 14 is a housing for the inner casing 12 and provides structural support for the inner casing, the vanes, blades and rotor shaft of the steam turbine.

The outer casing 14 is an assembly of casing segments, such as an upper segment 18 and a lower segment 20. The segments 18, 20 are joined by bolts 22 and nuts 24. Similar to the outer casing, the inner casing 12 is formed of an assembly of, for example, an upper casing segment 26 and a lower casing segment 28.

Bolts 34, such as stud bolts, extend through holes in the upper and lower casing segments 26, 28. A lower threaded end 35 of the bolt engages a threaded hole in the lower casing segment 28. A nut 36 engages an upper threaded end of the bolt 34. The tension applied by the nut 36 to the bolt 34 is applied to the upper and lower casing segments and secures the segments together. The nut is an example of a device at an upper end of the bolt which is used to place the bolt under pretension.

A cylindrical bushing 38 is mounted on the bolt 34 and positioned between the nut 36 and the inner casing 12. The bushing 38 is formed of a material having a high thermal expansion coefficient as compared to thermal expansion coefficients of the bolt 34 and inner casing 12.

Positioning the bushing 38 between the nut 36 and the inner casing 12 avoids loss of pretension of the bolt 34 due to unequal thermal expansion of the both and the inner casing. The bushing 38 thermally expands to a greater extent than the bolt 34 or the inner casing 12. The greater expansion of the bushing 38 causes the nut 36 to remain tight against the end of the bushing 38 as the casing 12, bolt 34 and nut 36 expand, albeit at different rates, due the high temperature steam flowing through the steam turbine.

The bushing 38 and the nut 36 extend above the inner casing 12 and into the cavity 40 between the inner casing and the outer casing 14. The bushing 38 has a length (L) which extends above the inner casing 12. The nut 36 is above the bushing 38.

A clearance (C) is needed between the nut 36 (or other upper most end of the bolt) and the inner surface of the outer casing 14. The nut 36 is raised if a bushing 38 is between the nut and the inner casing. Thus, the height of the upper end of the bolt assembly above the inner casing flange is the sum of the heights of the bushing (L) and the nut (H). A technical problem occurs if there is insufficient clearance (C) in the cavity 40 to receive the nut when elevated by a bushing.

This problem may occur when the inner casing 12 is replaced with a new inner casing 44 (FIG. 2) configured to operate at the high temperatures of modern day steam turbines, such as above 550 degrees Celsius. Replacing the inner casing while retaining the outer casing 14 allows the steam turbine 10 to be upgraded to operate at higher steam temperatures for a lower cost and effort than would be needed to replace both the outer casing and inner casing.

The new inner casing 44 may be formed of a high alloy material which has lower thermal expansion coefficient than the bolts used to fasten together the segments of the lower casing. If the clearance between the new inner casing 44 and the outer casing 14 is small, there will be insufficient clearance to insert a bushing between the inner casing and the nut. Without the bushing, the bolt may lose pretension as the bolt expands to a greater extent than the inner casing as hot steam flows through the steam turbine.

A solution has been invented to the technical problem of loss of pretension of bolts used to secure together segments of an inner casing where there is minimal clearance between the inner and outer casings.

Figure 2:
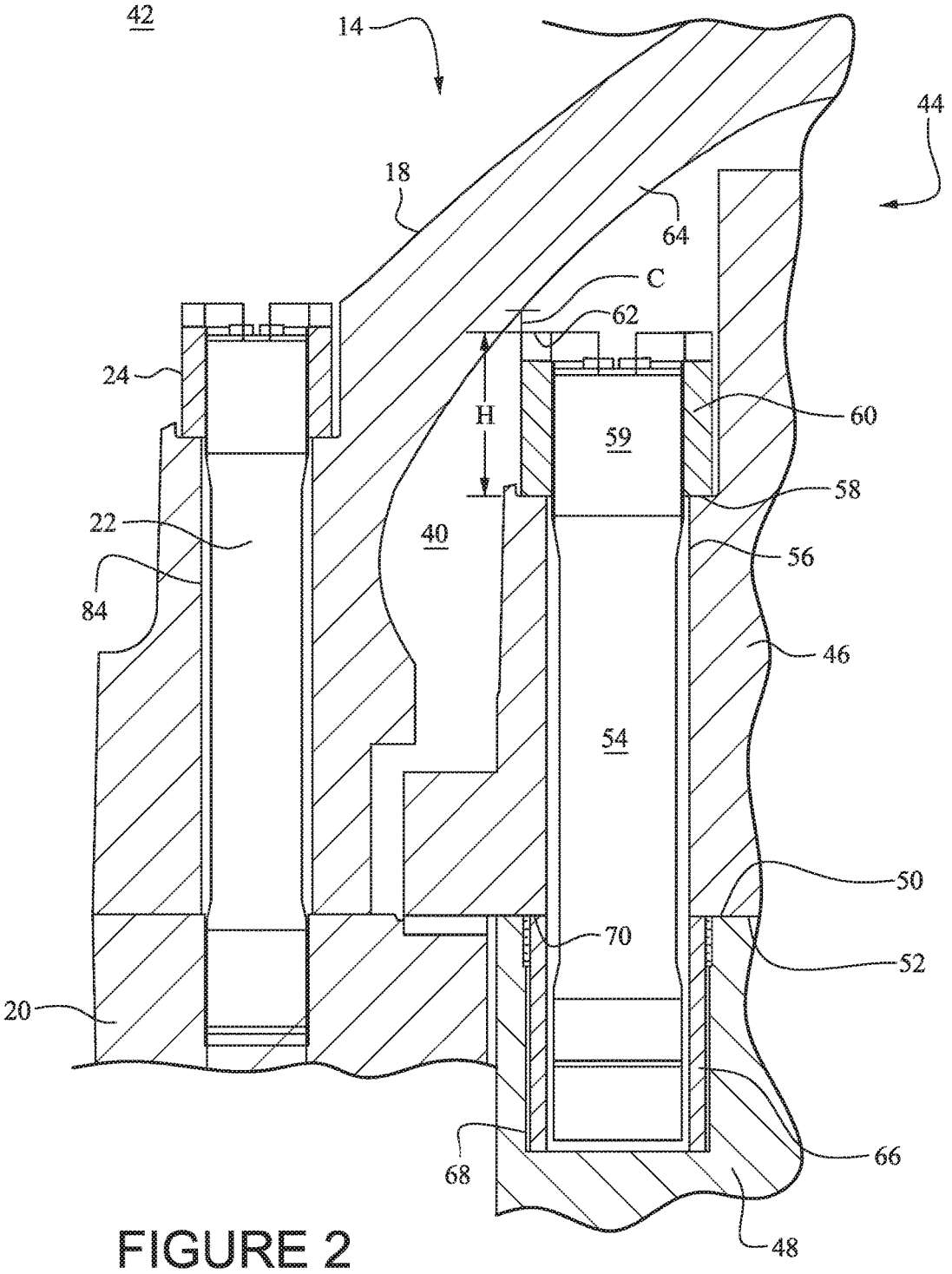
FIG. 2 shows in cross section a portion of a steam turbine where upper and lower casing sections are joined together by bolts.

FIG. 2 shows in cross section a portion of a steam turbine 42 having an outer casing 14 and an inner casing 44. The bolt 54 for the inner casing is seated in a novel austenitic bushing 66 that fits in a hole 56 in the lower casing section.

The steam turbine 42 shown in FIG. 2 is similar in many respects to the steam turbine 10 shown in FIG. 1 as indicated by the same reference numbers being used in FIGS. 1 and 2 to refer to similar components.

The inner casing 44 may be a high alloy metal material, such as a nine to twelve percent (9 to 12%) chromium steel. The inner casing may be formed of an upper inner casing segment 46 and a lower inner casing segment 48. The upper and lower inner casing segments house the vanes, rotating blades and other components of the steam turbine 42. The casing segments 46, 48 may enclose multiple rows of vanes and blades.

The upper and lower inner casing segments 46, 48 may each be generally arc-shape in cross section and have a length extending the entire or just a portion of the length of the steam turbine 42. The upper inner casing segment 46 has a lower surface 50 that abuts an upper surface 52 of the lower inner casing segment 48. The upper and lower inner casing segments 46, 48 are joined at their abutting surfaces 50, 52.

Bolts 54, such as stud bolts or other fasteners, fasten together the upper and lower inner casing segments 46, 48. A bolt hole 56 extends through the upper inner casing segment 46 from the lower surface 50 to an upper flange 58 of the casing. The bolt 54 extends through the bolt hole 56 such that an upper threaded end 59 of the bolt projects upward of the upper flange 58.

A nut 60 engages the threaded end 59 of the bolt 54 and seats on the upper flange 58 of the upper inner casing segment 46. By seating the nut 60 on the upper flange 58, the upper edge 62 projects into the cavity 40 between the inner and outer casings 14, 44 only the height (H) of the nut 60.

The amount of clearance (C) needed between the nut and the outer casing need only be that needed to accommodate the nut.

No bushing need be inserted between the nut and the upper flange 58. If a bushing is inserted, the bushing may have a reduced length (height) to ensure that there is clearance between the upper edge 62 of the nut 60 and the inner surface 64 of the outer casing 14.

A bushing 66 is seated in a hole 68 in the lower inner casing segment 48. The bushing 66 has an upper region that engages the lower inner casing segment 48 and a lower region that engages a lower threaded end 72 (FIG. 3) of the bolt 54. The bushing 66 supports the end 72 of the bolt 54 and secures the bolt in a fixed and immovable manner to the lower inner casing segment 48.

The bushing 66 may be entirely seated within the hole 68 of the lower inner casing segment 48. Thus, the bushing 66 does not increase the length (height) of the bolt and nut assembly extending above the flange 58 of the upper inner casing segment 46.

Figure 3:
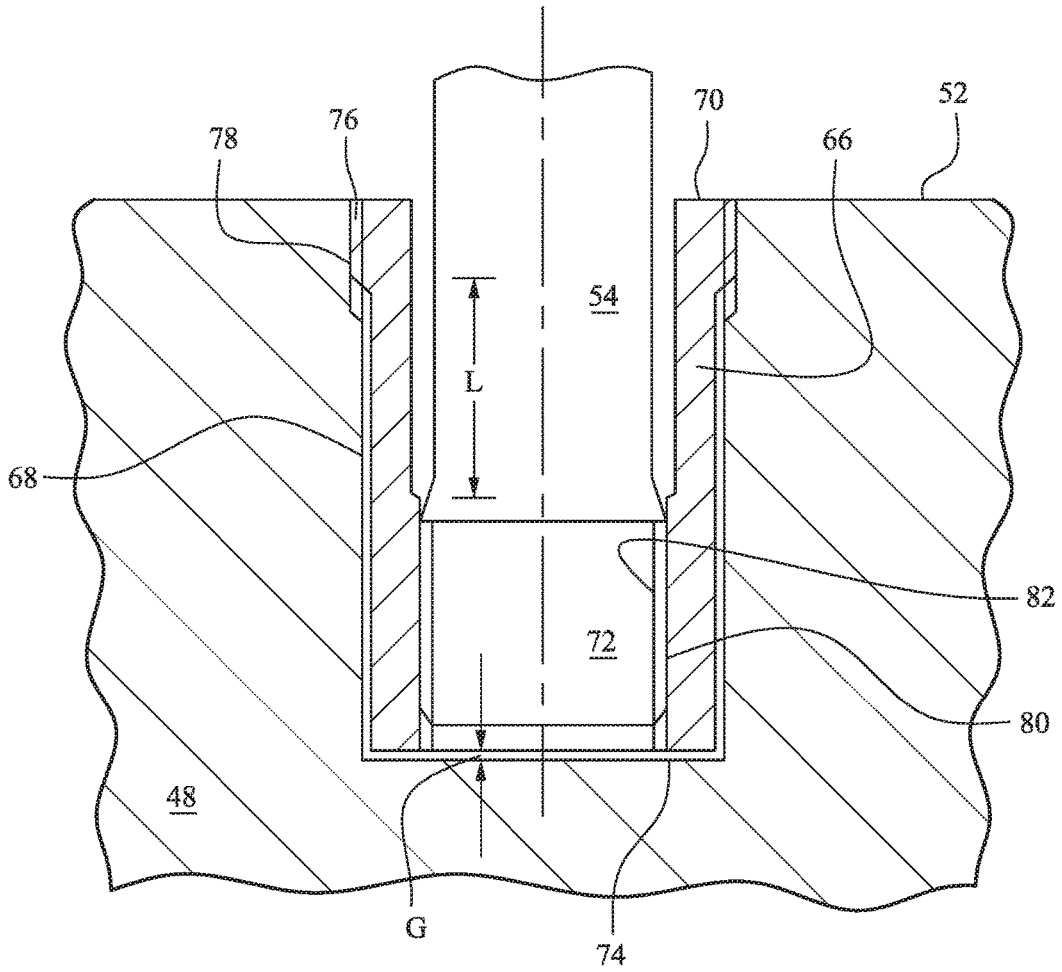
FIG. 3 shows in cross section the lower casing section, the bushing and the lower portion of the bolt.

FIG. 3 is an enlarged view of a cross section of the lower casing segment 48, bushing 66 and bolt 54. The bushing 66 may be cylindrical and have an upper rim 70 aligned with the upper surface 52 of the lower inner casing segment 48. Alternatively, the upper rim 70 of the bushing 66 may be slightly below the upper surface 52. The hole 68 in the lower inner casing segment 48 has a diameter or other dimension (s) slightly greater than the outer diameter or other outer dimension of the bushing 66. The dimensions of the hole 68 may be selected to allow the bushing 66 to fit into the hole.

The depth of the hole 68 may be greater than the length of the bushing 66 such that a gap (G) is between the bottom of the bushing 66 and the bottom 74 of the hole 68. The bottom 74 of the hole 68 is sufficiently below the bottom of the bushing 66 to allow for the thermal expansion of the bushing without the bushing reaching the bottom 74 of the hole. In determining the depth of the hole 68 and the diameter of the hole, consideration should be given to the greater thermal expansion of the bushing 66 as compared to the lower inner casing segment 48.

The bushing 66 has a upper region 76 that is secured to the hole 68 in the inner casing segment 48. For example, the upper region may have an outer threaded surface 76 at an upper region of the bushing. The outer threaded surface 76 engages a threaded inner surface 78 of the hole 68 which may be near the upper surface 52 of the casing segment. The engagement between of the outer threaded surface 76 on the bushing and the inner threaded surface 78 of the hole 68 secure the bushing 66 to the lower inner casing segment 48 such that the bushing is fixed to the segment. The engagement between these threaded surfaces 76, 78 may be the only engagement between the bushing 66 and the lower inner casing segment 48. There need be no engagement between the bushing 66 and the upper inner casing segment 46.

The portion of the bushing below the threaded surface 76 does not engage the inner casing segment and is free to expand and contract independently of the lower inner casing segment.

The bushing 66 has a hollow interior configured to receive the lower portion of the bolt 54. The interior surface of the bushing 66 has a threaded region 80 near its lower end. The threaded region 80 of the bushing engages a threaded region 82 at the lower region 72 of the bolt 54. The engagement between the threaded regions 80, 82 of the bushing 66 and the bolt 54 secure the bolt to the bushing. The bushing 66 supports the bolt in the hole 68 in the lower inner casing segment 48.

A length L of the bushing 66 is between the upper threated region 76 and the lower threaded region 80. The length L dimension of the bushing increases as the bushing expands while being heated. The length L dimension and the material of the bushing may be selected such that the expansion of the length dimension L of the bushing compensates for the difference in the expansion of the bolt 54 and the inner casing 44. The length L of the bushing 66 may be selected such that the expansion of the length L due to thermal heating is substantially the same as, e.g., within 20%, to the expected difference in the thermal expansion of the length of the bolt and the expected thermal expansion of the length of the hole 84 in the upper inner casing segment 46.

The increase in the length L of the bushing 66 due to heat expansion moves the lower ends of the bushing and bolt 54 into the hole 68 in the lower inner casing segment 48. By lowering the bolt 54 further into the hole 68, the bolt 54 is stretched to compensate for the loosening effect caused by the difference in thermal expansion of bolt 54.

The bushing 66 may be formed of a material having a higher thermal coefficient of expansion than the bolt 54 and the inner casing. For example, the bushing 66 may be formed of a high-alloyed austenitic stainless steel which has a higher thermal coefficient of expansion than bolts 54 formed of a nickel-based super alloy. Nickel-based super alloy bolts are commonly used to secure the inner casings segments of steam turbines. Moreover, nickel-based super alloy bolts typically have a higher thermal expansion coefficient than heat-resistant 9-12% chromium steels that are commonly used to form inner casing segments for steam turbines at the required steam conditions.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A casing comprising:

a first casing section and a second casing section configured to be joined to the first casing section to form the casing;

a first hole extending through a portion of the first casing section;

a second hole extending through a portion of the second casing section, wherein the first and second holes are configured to be in alignment while the first and second casing sections are joined;

a bushing seated in the second hole, wherein the bushing has a threaded outer surface confined to a first end region of the bushing and a threaded inner surface confined to a second end region, which is opposite to the first end region, wherein the threaded outer surface of the busing engages a threaded interior surface of the hole in the second casing section;

a fastener having a shaft configured to extend through the first hole, extend into the second hole, and seat in and engage the threaded inner surface of the bushing, wherein a thermal expansion coefficient of the bushing is greater than a thermal expansion coefficient of the shaft of the fastener, and the thermal expansion coefficient of the fastener is greater than the thermal expansion coefficients for each of the first and second casing sections.

2. The casing of claim 1 wherein the threaded outer surface of the bushing engages a threaded inner surface of the second hole and the threaded inner surface of the bushing engages a threaded outer surface of the shaft of the fastener.

3. The casing of claim 1 wherein the fastener includes a nut having a threaded inner surface engaging an end of the shaft and the nut has a lower surface abutting a surface of the first casing section.

4. The casing of claim 1 wherein the casing is an inner casing which is encased in an outer casing.

5. The casing of claim 1 wherein the casing is an inner casing of a steam turbine.

6. The casing of claim 1 wherein the fastener is a bolt and nut assembly and the shaft is a threaded shaft of the bolt.

7. The casing of claim 1 wherein the bushing has a length sized such that thermal expansion of the bushing extends the shaft into the second hole a distance commensurate with a lengthwise thermal expansion of the shaft.

8. The casing of claim 1 wherein the first casing section is an upper casing section and the second casing section is a lower casing section.

9. A casing for a turbomachine comprising:

a first casing section having a first mating surface;

a second casing section having a second mating surface configured to abut the first mating surface of the first casing section;

a first bolt hole extending through a portion of the first casing section and having an opening at the first mating surface;

a second bolt hole extending through a portion of the second casing section and having an opening at the second mating surface, wherein the first and second bolt holes are configured to be in axial alignment while the first mating surface abuts the second mating surface;

a bushing seated in the second bolt hole, wherein the bushing has a threaded outer surface confined to a first end region of the bushing and a threaded inner surface confined to a second end region, which is opposite to the first end region, wherein the threaded outer surface of the bushing engages a threaded inner surface of the second bolt hole in the second casing section; and a bolt configured to extend through the first both hole, extend into the second bolt hole, and seat in and engage the threaded inner surface of the bushing, wherein a thermal expansion coefficient of the bushing is greater than a thermal expansion coefficient of the bolt, and the thermal expansion coefficient of the bolt is greater than the thermal expansion coefficients for each of the first and second casing sections.

10. The casing of claim 9 wherein the threaded outer surface of the bushing engages a threaded inner surface of the second bolt hole and the threaded inner surface of the bushing engages a threaded outer surface of the bolt.

11. The casing of claim 9 further comprising a nut configured to engage an end of the bolt.

12. The casing of claim 9 wherein the casing is an inner casing which is encased in an outer casing.

13. The casing of claim 9 wherein the casing is an inner casing of a steam turbine.

14. A method to fasten casing sections for a turbomachine comprising:

inserting a bushing in a first hole in first casing section, wherein the bushing has a threaded outer surface confined to a first end region of the bushing and a threaded interior surface confined to a second end region, wherein the second end region is opposite to the first end region;

engaging the threaded outer surface confined to the first end region of the bushing with an inner threaded surface near an open end of the first hole;

inserting a bolt in the bushing and the first hole;

engaging a threaded outer surface near a first end of the bolt with the threaded inner surface confined to the second end of the bushing;

joining the first casing section to a second casing section such that the first hole is aligned with a second hole in the second casing section;

extending the bolt through the second hole, and engaging a nut to threads near a second end of the bolt, wherein a thermal expansion coefficient of the bushing is greater than a thermal expansion coefficient of the bolt, and the thermal expansion coefficient of the bolt is greater than a thermal expansion coefficients for each of the first and second casing sections.

15. The method of claim 14 wherein the joining of the first casing section to the second casing section occurs before or after the engagement of the threaded outer surface of the bolt with the threaded inner surface of the bushing.

16. The method of claim 14 further comprising housing the casing sections in an outer casing.

17. The method of claim 14 wherein the engagement of the nut includes tightening the nut against a flange of the second casing section.

18. The method of claim 14 wherein the turbomachine is a steam turbine and the first and second casing sections form an inner casing which is housed in an outer casing.

* * * * *